US009234358B2

(12) United States Patent
Harper et al.

(10) Patent No.: US 9,234,358 B2
(45) Date of Patent: Jan. 12, 2016

(54) SKIMMING TOOL

(75) Inventors: Lee Harper, Waltham Abbey (GB); Kenneth Whittaker, Marlow (GB); Scott Rampling, Marlow (GB)

(73) Assignee: Scott Cutters Limited, Marlow Buckinghamshire (GB)

( * ) Notice: Subject to any disclaimer, the term of this patent is extended or adjusted under 35 U.S.C. 154(b) by 0 days.

(21) Appl. No.: 14/129,207

(22) PCT Filed: Jun. 19, 2012

(86) PCT No.: PCT/GB2012/051408
§ 371 (c)(1),
(2), (4) Date: Dec. 24, 2013

(87) PCT Pub. No.: WO2013/001277
PCT Pub. Date: Jan. 3, 2013

(65) Prior Publication Data

US 2014/0123425 A1 May 8, 2014

(30) Foreign Application Priority Data

Jun. 30, 2011 (GB) ..... 1111168.9
Feb. 15, 2012 (GB) ..... 1202575.5

(51) Int. Cl.
*E04F 21/16* (2006.01)

(52) U.S. Cl.
CPC ..... *E04F 21/16* (2013.01); *E04F 21/161* (2013.01); *E04F 21/162* (2013.01); *E04F 21/163* (2013.01)

(58) Field of Classification Search
CPC ..... E04F 21/16; E04F 21/163; B05C 17/005; B05C 17/10
USPC ..... 15/235.4, 235.6, 236.01, 245, 245.1
See application file for complete search history.

(56) References Cited

U.S. PATENT DOCUMENTS

| | | | | |
|---|---|---|---|---|
| 3,676,888 | A | 7/1972 | Akers | |
| 3,766,591 | A * | 10/1973 | Soito | 15/245 |
| 3,878,581 | A | 4/1975 | Perna | |
| 4,202,093 | A * | 5/1980 | Wallerstein | 30/169 |
| 4,386,443 | A * | 6/1983 | Kubick | 15/245 |
| 4,447,929 | A * | 5/1984 | Hennig et al. | 15/256.5 |
| 4,611,363 | A * | 9/1986 | Samuelsson | 15/245 |
| 4,654,919 | A | 4/1987 | Liberman | |

(Continued)

FOREIGN PATENT DOCUMENTS

| | | |
|---|---|---|
| CA | 2 538 272 | 9/2007 |
| CH | 399 965 | 9/1965 |

(Continued)

OTHER PUBLICATIONS

British Search Report dated Feb. 13, 2014 for Application No. GB1309878.5 (3 pages).

(Continued)

*Primary Examiner* — Monica Carter
*Assistant Examiner* — Michael Jennings
(74) *Attorney, Agent, or Firm* — Christie, Parker & Hale, LLP

(57) ABSTRACT

A skimming tool 1 for smoothing and levelling wet plaster applied to a surface comprising: an elongate generally rectangular, flat, flexible, elastomeric web 2 and an elongate, substantially rigid handle 3 connected to and extending along substantially the length of one long edge of the web, wherein the handle is adapted to be gripped by the user.

11 Claims, 9 Drawing Sheets

(56) References Cited

U.S. PATENT DOCUMENTS

| | | | | |
|---|---|---|---|---|
| 4,941,228 | A * | 7/1990 | Belanger et al. | 15/245 |
| 4,946,360 | A | 8/1990 | Brown | |
| 5,321,868 | A * | 6/1994 | Coulson et al. | 15/245.1 |
| 5,337,442 | A * | 8/1994 | Stewart | 15/236.01 |
| 5,337,523 | A * | 8/1994 | Walsh | 451/502 |
| 5,381,581 | A * | 1/1995 | Samuelsson | 15/245 |
| 5,528,793 | A * | 6/1996 | Schbot | 15/245 |
| 5,539,949 | A * | 7/1996 | Stanton | 15/121 |
| 5,660,632 | A * | 8/1997 | Volpe et al. | 118/213 |
| 5,809,605 | A * | 9/1998 | Gringer | 15/121 |
| 5,946,762 | A * | 9/1999 | Dionisio | 15/245 |
| 6,094,777 | A * | 8/2000 | Windmeisser | 15/401 |
| 6,243,911 | B1 * | 6/2001 | Varner | 15/245 |
| 6,453,970 | B1 * | 9/2002 | Stone et al. | 156/579 |
| 6,625,840 | B1 * | 9/2003 | Hansen et al. | 15/245 |
| 6,931,690 | B2 * | 8/2005 | Cox | 15/245 |
| 7,115,172 | B1 | 10/2006 | Teodorovich | |
| 7,134,163 | B2 * | 11/2006 | Varner | 15/245 |
| 7,757,336 | B2 * | 7/2010 | Varner | 15/245 |
| 8,104,426 | B2 * | 1/2012 | Gringer | 118/504 |
| 8,214,964 | B1 * | 7/2012 | Coleman | 15/236.05 |
| 8,321,991 | B2 * | 12/2012 | Robideau | 15/245.1 |
| 8,365,378 | B1 * | 2/2013 | Lenart | 29/253 |
| 2004/0216256 | A1 * | 11/2004 | Varga | 15/245 |
| 2005/0087084 | A1 * | 4/2005 | Gray | 101/123 |
| 2006/0254009 | A1 * | 11/2006 | Tsai et al. | 15/121 |
| 2006/0260084 | A1 * | 11/2006 | Guizzi | 15/245 |
| 2006/0277708 | A1 * | 12/2006 | Kim | 15/245 |
| 2007/0056133 | A1 * | 3/2007 | Pyatt et al. | 15/235.4 |
| 2007/0277340 | A1 * | 12/2007 | Lee | 15/245 |
| 2011/0138566 | A1 * | 6/2011 | Wang | 15/236.01 |
| 2011/0271476 | A1 * | 11/2011 | Robideau | 15/245.1 |
| 2012/0036668 | A1 * | 2/2012 | Farland et al. | 15/245.1 |

FOREIGN PATENT DOCUMENTS

| | | | |
|---|---|---|---|
| DE | 88 07 011.5 | | 7/1988 |
| DE | 20 2009 017 282 | U1 | 12/2010 |
| EP | 2289637 | A1 | 3/2011 |
| FR | 2 327 374 | | 5/1977 |
| FR | 2969192 | A1 | 6/2012 |
| GB | 887121 | | 1/1962 |
| WO | WO 94/03095 | A1 | 2/1994 |
| WO | WO 02/091896 | A1 | 11/2002 |
| WO | WO 2007/135247 | A1 | 11/2007 |
| WO | WO 2008/142221 | A2 | 11/2008 |
| WO | WO 2009/026679 | A1 | 3/2009 |
| WO | WO 2013/001277 | A2 | 1/2013 |

OTHER PUBLICATIONS

International Search Report and Written Opinion of the International Searching Authority mailed Feb. 17, 2014 for Application No. PCT/GB2013/052002 (12 pages).

International Search Report and Written Opinion, corresponding to PCT/GB2012/051408, dated Jan. 8, 2013, 12 pages.

British Search Report of corresponding GB1111168.9, dated Oct. 25, 2011. 3 pages.

* cited by examiner 3
21
11
12
10
20
13
2

3
13
22

A
3
20
11
10
13
2

SKIMMING TOOL

CROSS-REFERENCE TO RELATED APPLICATION(S)

This application is a National Phase Patent Application and claims priority to and benefit of International Application Number PCT/GB2012/051408, filed on Jun. 19, 2012, which claims priority to and the benefit of GB Patent Application Number 1111168.9, filed on Jun. 30, 2011, and GB Patent Application Number 1202575.5, filed on Feb. 15, 2012, the entire disclosures of which are incorporated herein by reference.

The invention relates to a "ruling off" skimming tool for smoothing and levelling wet finish coat plaster applied to a surface such as a wall or ceiling.

Conventionally, plaster is applied to walls and ceilings using a plaster trowel which comprises a flat rectangular stainless steel sheet having dimensions of about 280 mm to 460 mm by 120 mm with a generally cylindrical handle mounted spaced from and parallel to the sheet. The same tool is used for smoothing and levelling the plaster once it has been applied.

A known plaster "ruling off" levelling tool, known as a 'Darby', comprises an extruded aluminium elongate body which may be hollow or solid. The known tool sometimes has a pair of spaced handles extending perpendicularly there from. The spacing of the handles is adjustable in some cases. However, the 'Darby' tool, being generally rigid and inflexible, is only useful for "ruling off" and levelling backing plaster (first coat plaster) or scratch coat sand and cement render (first coat render).

The invention provides a new long tool for skimming, smoothing and levelling finish coat plaster (final coat plaster) reducing finish plastering times by approximately 75%. The new tool can make it possible for a single operative to tackle larger areas within short drying times/conditions due to the advantage of the increase speed. In addition another advantage of the tool is that levelling off of finish plaster on uneven substrates becomes possible giving an improved finish over substantially shorter and inflexible conventional stainless steel sheet trowels.

The invention provides a skimming tool for smoothing and levelling wet finish coat plaster applied to a surface comprising: an elongate generally rectangular, flat, flexible, elastomeric web and an elongate, substantially rigid handle connected to and extending along substantially the length of one long edge of the web, wherein the handle is adapted to be gripped by the user at any point along its length.

Embodiments of the inventions are described below with reference to the accompanying drawings, in which.

Figure 1:
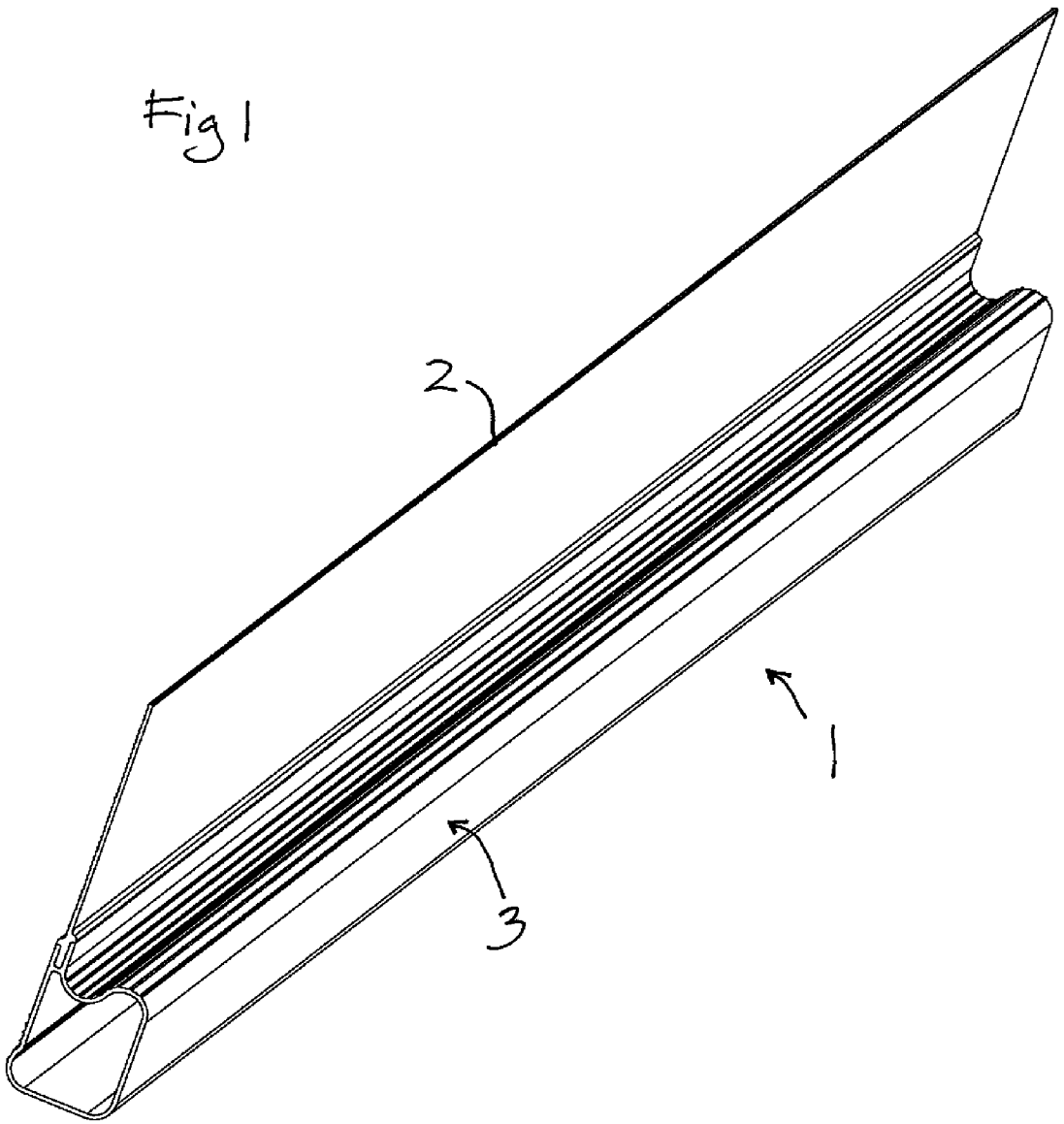
FIG. 1 is a perspective view, from above, of a skimming tool.
Figure 2:
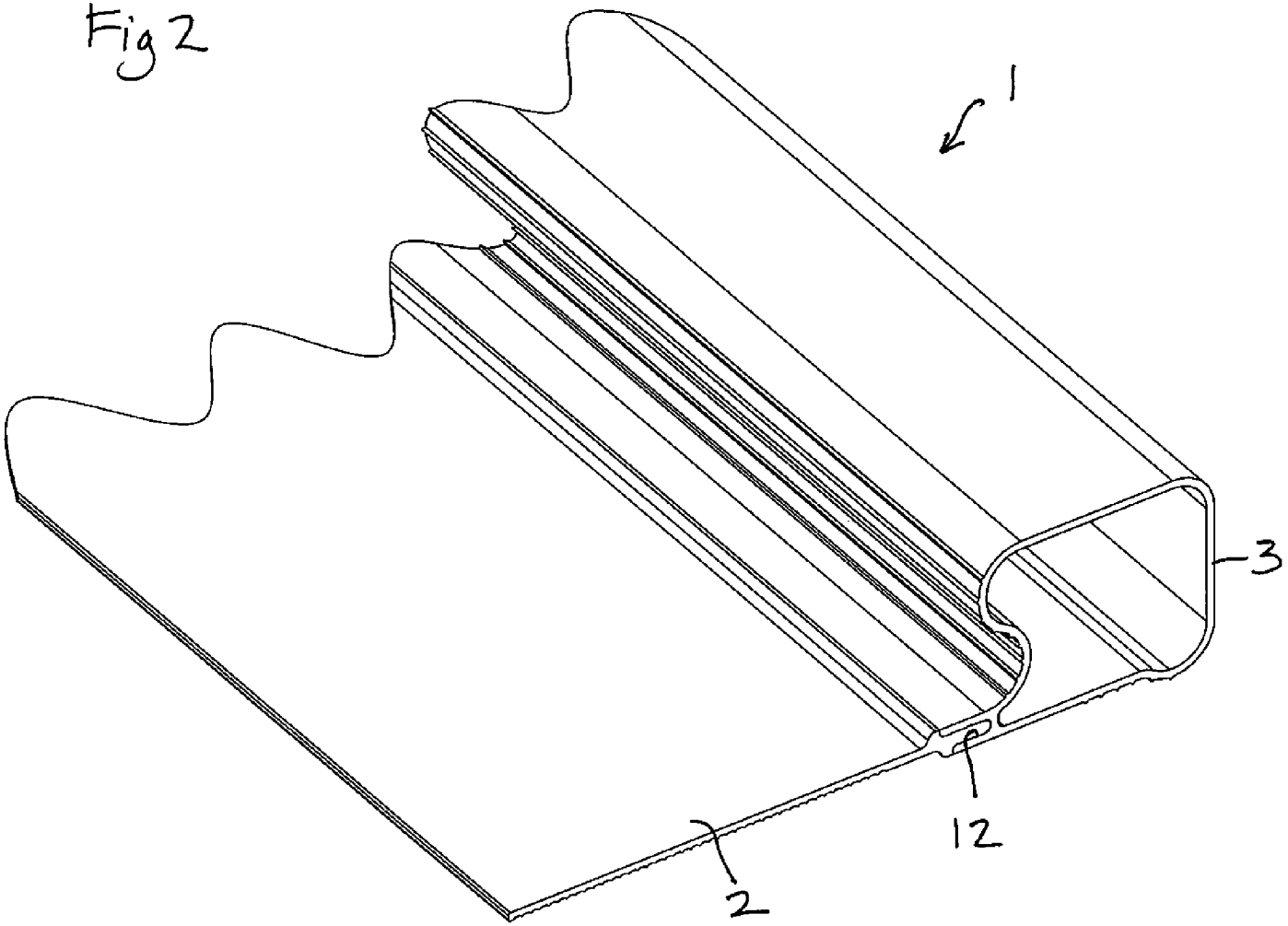
FIG. 2 is a perspective view, from above, showing a short end portion of the tool.
Figure 3:
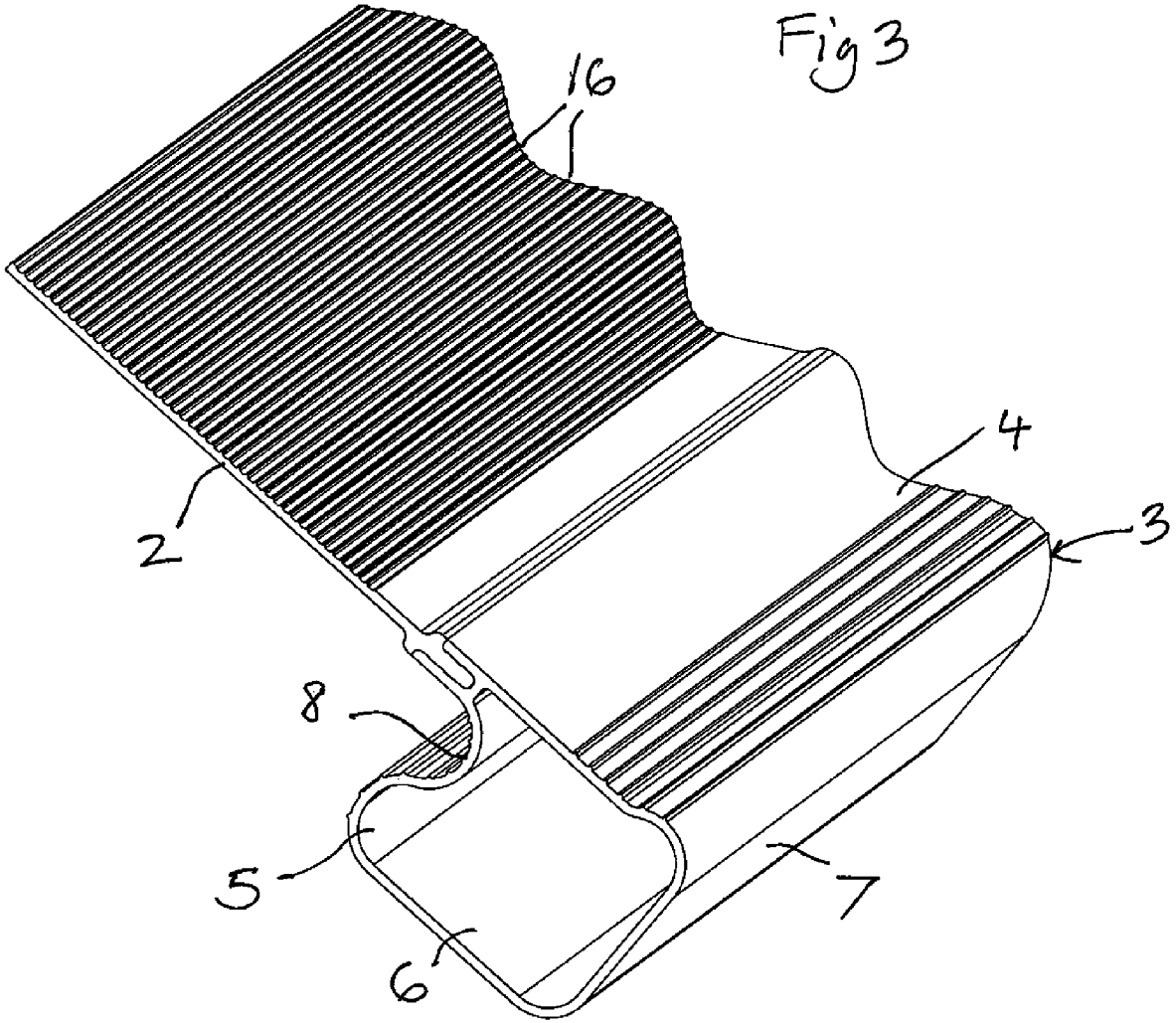
FIG. 3 is a perspective view, from below, showing a short end portion of the tool.
Figure 4:
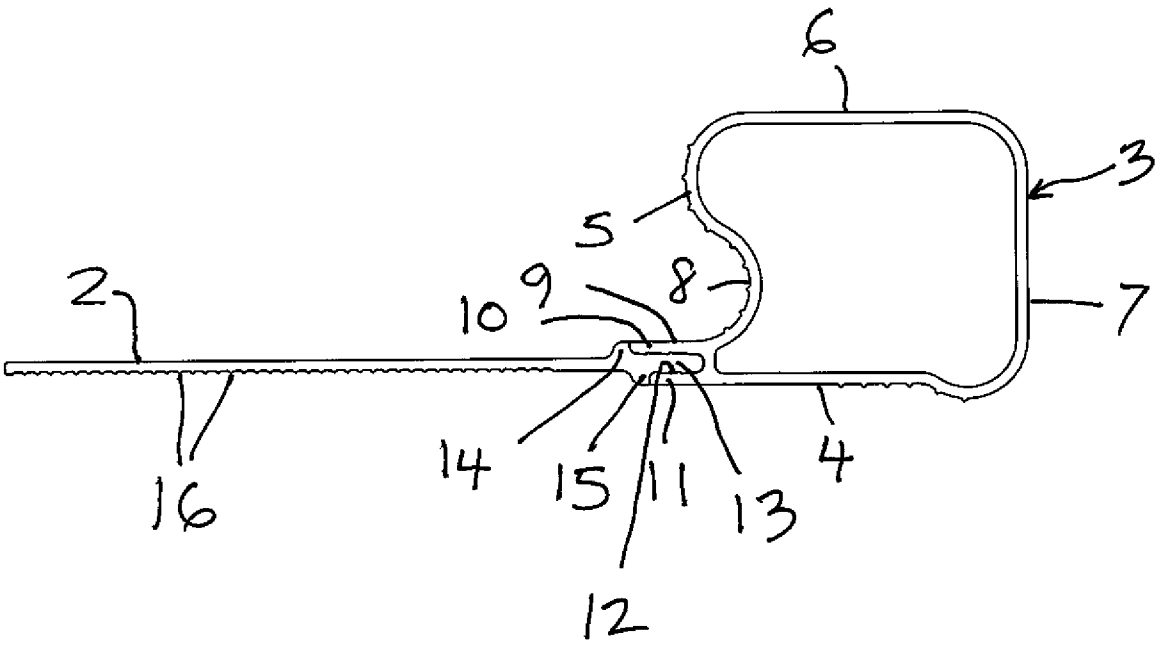
FIG. 4 is an end view of the tool.

The drawings show a long skimming tool 1 for smoothing and levelling finish coat plaster applied to a surface such as a wall or a ceiling. The tool comprises a plaster engaging blade in the form of an elongate, generally rectangular, flat, flexible, elastomeric web 2 which is joined to a substantially rigid, elongate handle 3 which extends along substantially the entire length of one long edge of the web. The handle 3 has a cross-sectional profile which is substantially constant along its length and is thereby adapted to be gripped by the user at any point along its length.

In the preferred embodiments, the web 2 and handle 3 have a length of 600 mm to 1500 mm, preferably about 1200 mm and the operative width of the web is 70 to 100 mm, preferably about 90 mm. If the operative width is less than about 70 mm, the tool becomes too rigid and inflexible. A tool having a length shorter than 600 mm may be useful but if the length is much shorter than that, some benefits of the tool are lost. A longer tool may be provided but only up to about 1800 mm is practicable for most users although tools of up to 2000 mm or even longer may be practicable for some users. In the preferred embodiments, the web 2 is an extrusion formed of a rigid or semi rigid PVC and has a thickness of between 1.0 and 3.0 mm, preferably about 1.7 mm. This gives the web sufficient stiffness and flexibility to operate efficiently.

The handle 3 is a hollow extrusion formed of aluminium and is substantially rigid. The handle has a generally rectangular profile comprising a first side 4 which is generally co-planar with the web, a second side 5, generally perpendicular to the web, a third side 6 parallel to the first side and a fourth side 7 parallel to the second side. The second side 5 is formed in an S profile providing a curved recess 8 extending along the handle and adapted to receive the fingertips of the user. The ergonomic design of the handle allows it to be comfortably gripped by the user at all times and especially when skimming overhead.

The handle 3 is provided with a bifurcated flange 9 at the junction between the first and second sides 4, 5 of the handle and extending generally in the plane of the web 2. The limbs 10 and 11 of the flange define a recess 12 in the form of a channel which extends along the length of the handle. The recess receives and holds the edge portion 13 of the web. Shoulders 14, 15 are formed on the web to abut the ends of the limbs 10 and 11. In the embodiment of FIGS. 1 to 6, the recess 12 receives the edge portion 13 as a snap fit by virtue of barbed formations in the recess and on the portion 13.

Figure 6:
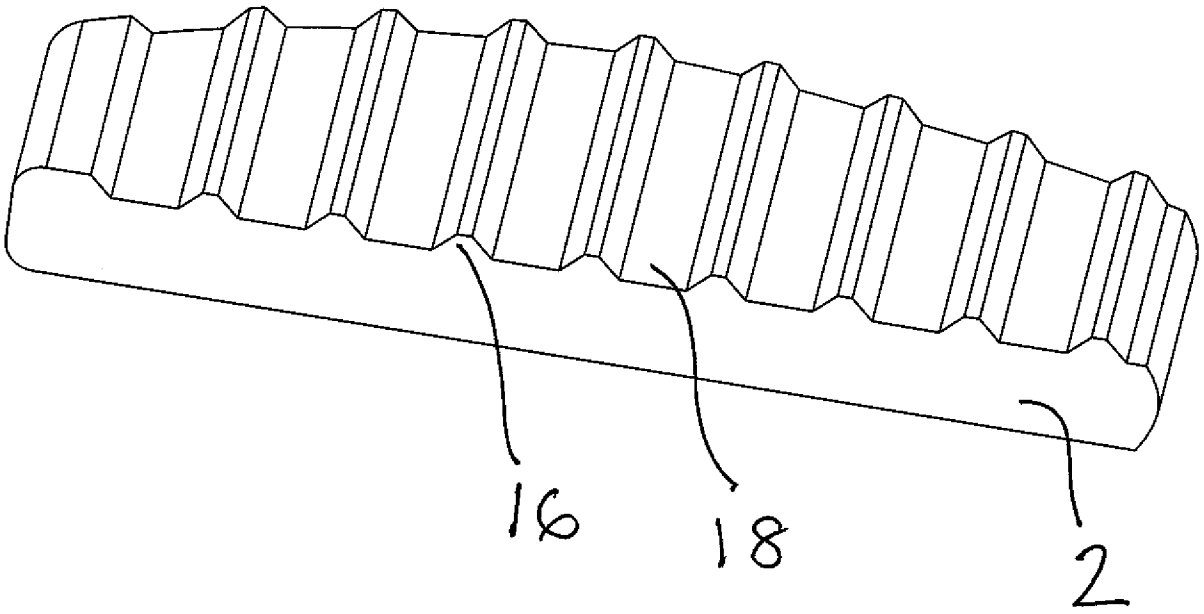
FIG. 6 is an enlarged fragmentary view showing a portion of the blade of the tool.

The lower surface of the web, which is the operative surface which engages the plaster being smoothed, is formed with a plurality of parallel grooves 18 extending along the length thereof and defining parallel ridges 16 therebetween. The ridges 16 and the flat grooves 18 therebetween are best seen in FIG. 6. This ridged surface helps to hold onto the plaster/material and distribute it evenly across peaks and troughs in the uneven substrate surface, thus facilitating an improved flatter finish. In addition the ridges also hold the surplus plaster on the tool during the operation preventing mess and spillage. The series of ridges along the surface strengthen the web but allow a slender profile and flexibility.

Figure 5:
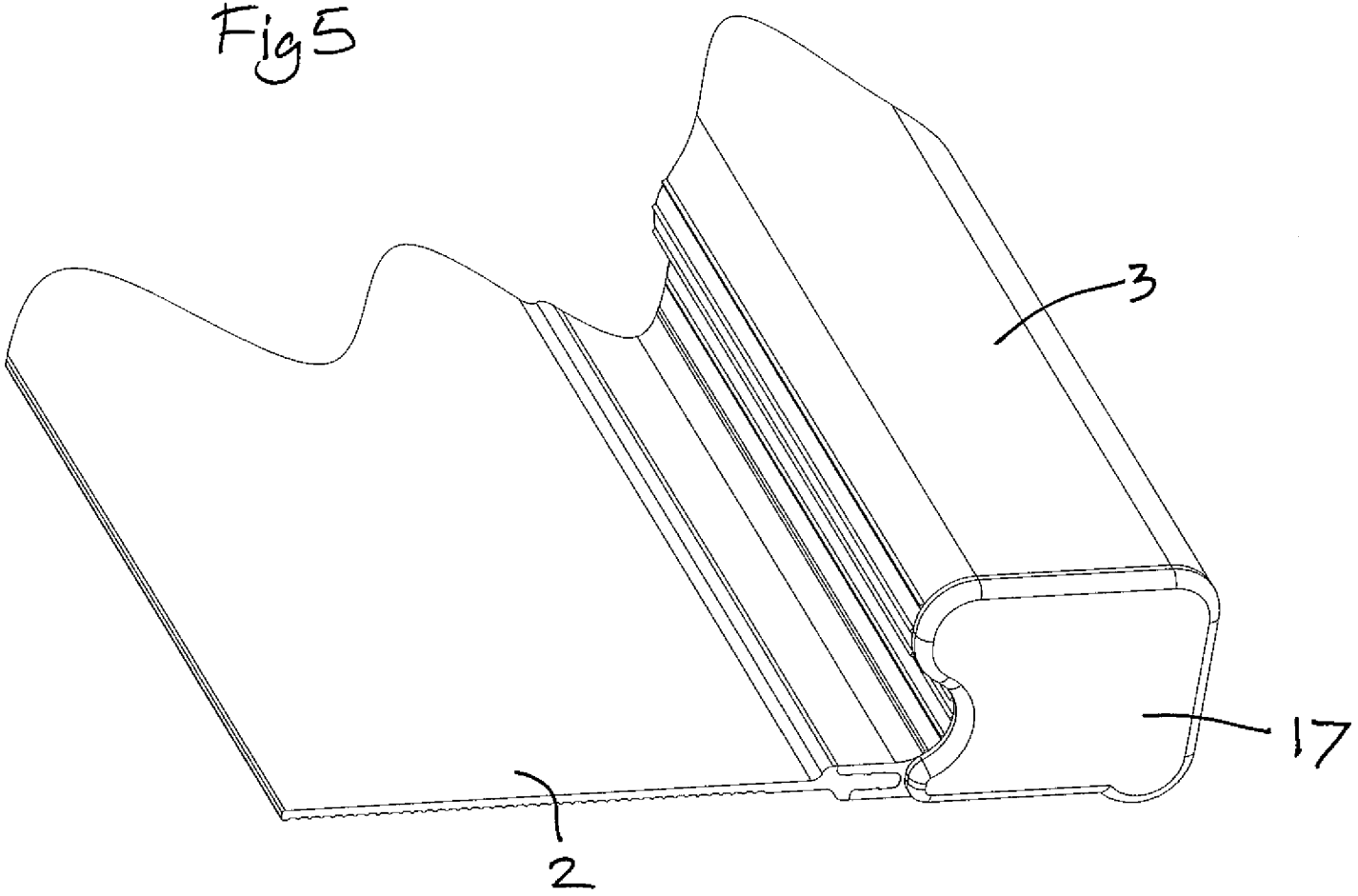
FIG. 5 is a perspective view, from above, of an end portion of the tool with an end cap in place.
Figure 10:
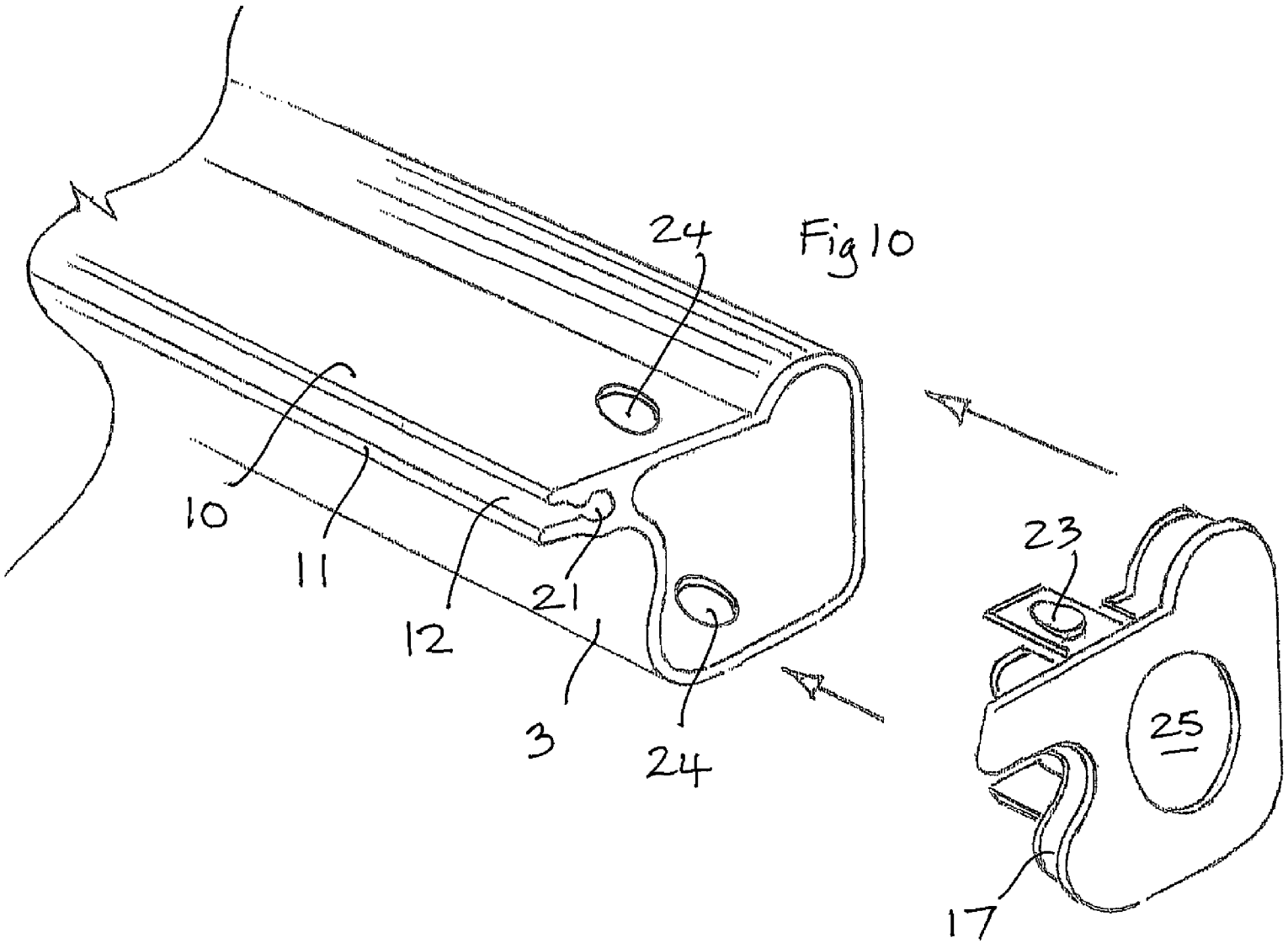
FIG. 10 shows an end portion of the handle of the second embodiment.
Figure 11:
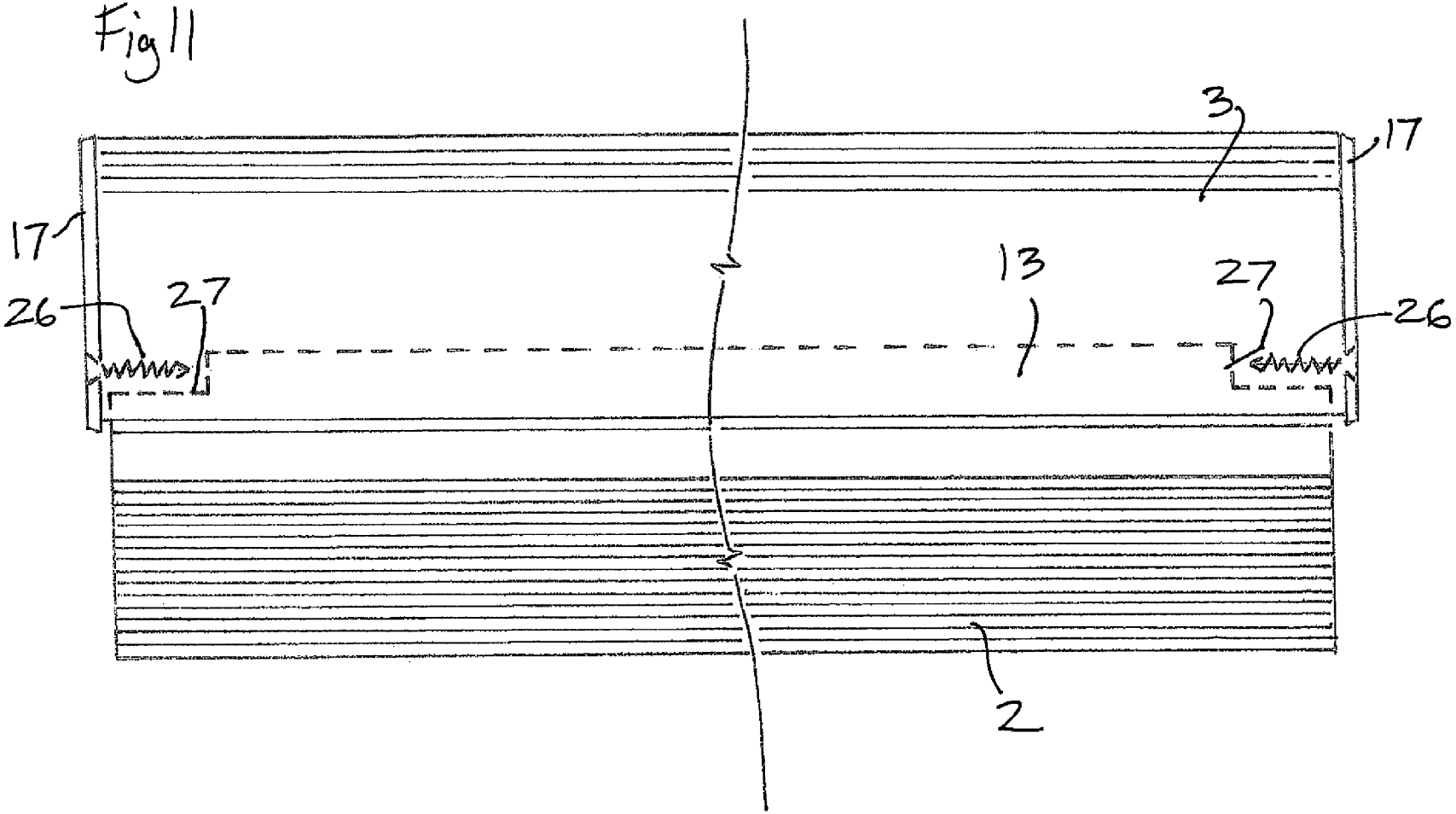
FIG. 11 is a plan view of a third embodiment.

The hollow body of the handle is closed by end caps 17 as shown in FIGS. 5, 10 and 11.

FIGS. 7 to 11 show some further embodiments, which, except as discussed, are the same as the embodiment of FIGS. 1 to 6.

Figures 7, 8, 9:
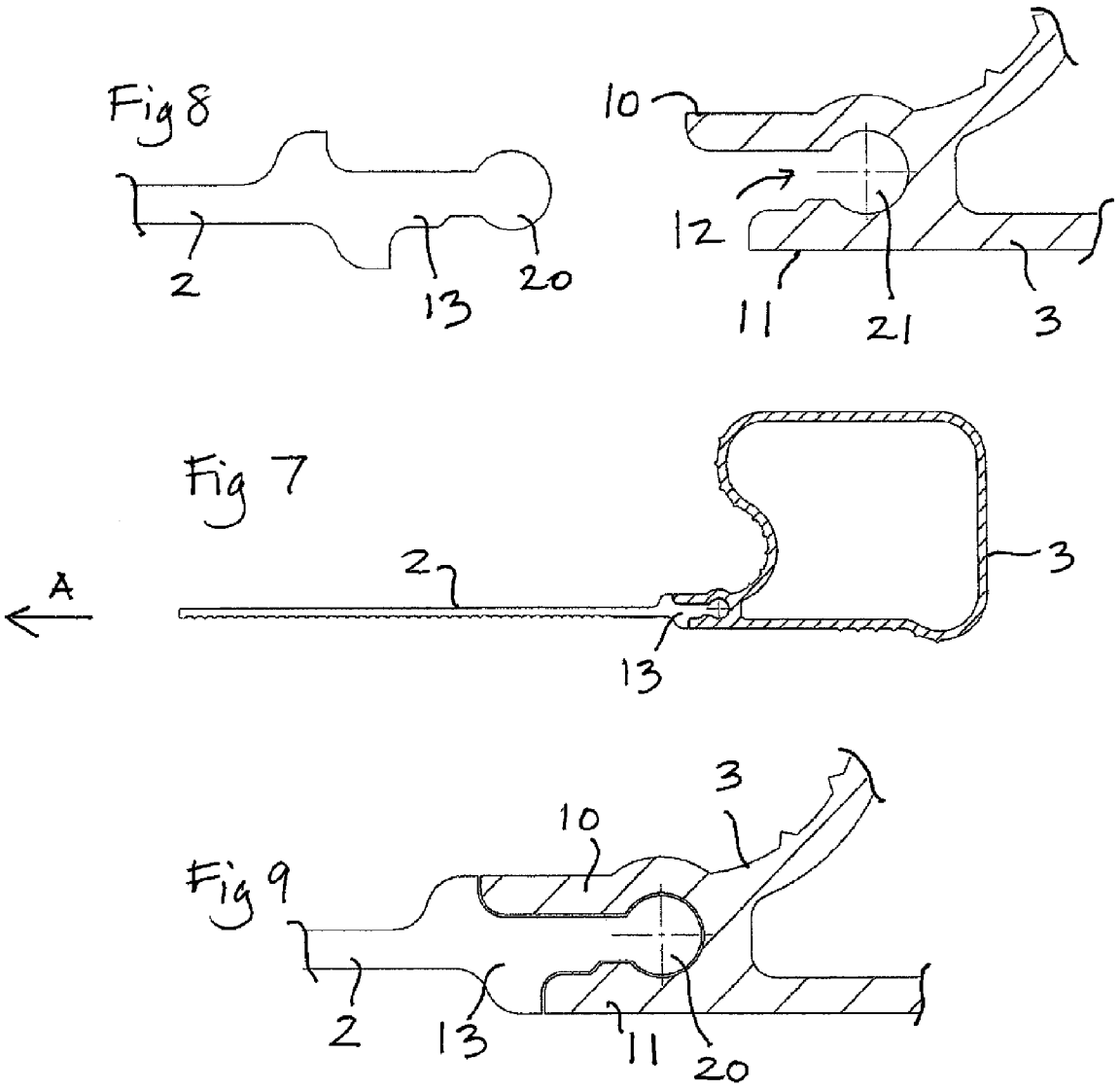
FIG. 7 is an end view of a second embodiment of the tool.
FIGS. 8 and 9 show details of portions of the second embodiment.

FIGS. 8 and 9 show a detailed cross-section through part of the handle and web of a second embodiment. In this embodiment, the handle is formed with a bifurcated flange 9, as before, with limbs 10 and 11 which define the recess 12. In this embodiment, the edge portion 13 of the web is received and held in the recess in a slack fit having a nominal clearance all round the edge portion 13 of about 0.125 mm at about 20° C. The edge portion 13 has an enlarged section 20 running therealong which is held in a complimentary enlarged section 21 of the recess. The enlarged sections of the web and the recess are in the form of a ball and socket when viewed in cross-section. The shapes and dimensions of the web and recess, and in particular, the loose or slack fit, permit sliding movement of the edge portion 13 of the web along the length of the recess but prevent movement of the web out of the recess in the direction perpendicular to the length of the recess indicated by arrow A in FIG. 7. In this embodiment, the direction A lies in the plane of the web. In this embodiment, the web is fitted to the handle by sliding the edge portion 13 of the web into and along the recess 12 on the handle.

The loose or slack fit of the edge of the web in the handle serves various functions. Firstly, it allows the web to expand differentially to the linear expansion of the handle. This is especially important where the handle and web are made of different materials since without this facility the web might expand more than the handle under ambient conditions. If the web is held rigidly in the handle, it may tend to kink or buckle along its length making it difficult or impossible to use correctly. Secondly, this arrangement enables simple replacement of a worn or damaged web into a handle. Other web profiles of rigid or semi-rigid design may be introduced for other different tasks to be performed.

FIG. 10 shows an end portion of the handle with an end cap 17 which is a push fit into the open end of a hollow extruded handle and is retained by catches 23 snapping into apertures 24. The end cap has an opening 25 which permits drainage of water from within the hollow handle. A portion of the end cap overlies the open end of the recess 12 to retain the web in place.

FIG. 11 shows a tool in which the end caps are held in place by self tapping screws 26 which are screwed into the open ends of the enlarged section 21 of the recess 12. The end sections of the web have cut away portions 27 which prevent engagement with the screw. The length of the web is selected such that it can expand more than the handle without engaging the screws or the end caps.

In an alternative construction (not shown) the handle and web may be formed of a single plastic extrusion formed of a single material, preferably PVC. In another alternative, the handle and web may be made of different plastic materials, or simply of differently coloured plastic materials blending together at a join along the length of the tool.

In a yet further embodiment (not shown) the handle can be solid and made from wood or other suitable material. In this embodiment the web may be extended to overlie the first side of the handle and be glued or otherwise fixed thereto.

The invention claimed is:

1. A skimming tool for smoothing and levelling wet finish coat plaster applied to a surface comprising:

a plaster engaging blade in the form of an elongate generally rectangular, generally planar, flexible, elastomeric web; and an elongate, substantially rigid handle configured to connect to the web, wherein the handle is adapted to be gripped by the user at any point along its length, the handle defining a recess extending along the length of the handle, wherein the handle has a generally rectangular profile with a first side generally co-planar with the web and a second side generally perpendicular to the web and being formed with a curved recess therealong adapted to receive the fingertips of the user, and wherein, when the handle is coupled to the plaster engaging blade:

a proximal edge portion of the web is received in the recess;

the handle extends along substantially the length of the proximal edge portion of the web; and the web extends outwardly from the handle in a planar direction between the proximal edge portion and a distal edge portion spaced apart from the handle.

2. A skimming tool as claimed in claim 1, wherein the web comprises a first surface and a second surface opposite the first surface, and wherein at least a portion of the second surface of the web comprises a plurality of parallel ridges extending along a length of the web.

3. A skimming tool as claimed in claim 1, wherein the proximal edge portion of the web has an enlarged section which is configured to be held in a complementary enlarged section of the recess to prevent movement of the web out of the recess in a direction perpendicular to a length of the recess.

4. A skimming tool as claimed in claim 3, wherein the enlarged sections of the web and the recess are in the form of a ball and socket.

5. A skimming tool as claimed in claim 1, wherein the handle is hollow and is closed off by end removable caps.

6. A skimming tool as claimed in claim 5, wherein the end caps, when in place, prevent lengthwise movement of the web out of the recess.

7. A skimming tool as claimed in claim 1, wherein the handle and the web are formed by extrusion.

8. A skimming tool as claimed in claim 1, wherein the handle is formed of aluminium and the web is formed of PVC.

9. A skimming tool as claimed in claim 1, wherein the web and the handle both have a length greater than about 600 mm.

10. A skimming tool as claimed in claim 9, wherein the web and the handle have a length of 600 mm to 1500 mm.

11. A skimming tool as claimed in claim 10, wherein the web and the handle have a length of about 1200 mm.

* * * * *